US012115412B2

(12) United States Patent
Yeo

(10) Patent No.: US 12,115,412 B2
(45) Date of Patent: Oct. 15, 2024

(54) STAND TYPE WALKING EXERCISE DEVICE

(71) Applicant: REDESIGN CO., LTD., Busan (KR)

(72) Inventor: Tae Yeong Yeo, Busan (KR)

(73) Assignee: REDESIGN CO., LTD., Busan (KR)

( * ) Notice: Subject to any disclaimer, the term of this patent is extended or adjusted under 35 U.S.C. 154(b) by 125 days.

(21) Appl. No.: 17/432,599

(22) PCT Filed: Nov. 27, 2020

(86) PCT No.: PCT/KR2020/017140

§ 371 (c)(1),
(2) Date: Aug. 20, 2021

(87) PCT Pub. No.: WO2021/107702

PCT Pub. Date: Jun. 3, 2021

(65) Prior Publication Data

US 2022/0062695 A1 Mar. 3, 2022

(30) Foreign Application Priority Data

Nov. 28, 2019 (KR) ..... 10-2019-0155915

(51) Int. Cl.
*A63B 22/00* (2006.01)
*A63B 23/04* (2006.01)

(52) U.S. Cl.
CPC ..... *A63B 22/0046* (2013.01); *A63B 23/0405* (2013.01); *A63B 2022/0094* (2013.01)

(58) Field of Classification Search
CPC ..... A63B 22/0048; A63B 22/0061; A63B 22/0064; A63B 22/0066; A63B 22/0087;
(Continued)

(56) References Cited

U.S. PATENT DOCUMENTS 7,621,861 B1 * 11/2009 Kalember ..... A63B 22/14 482/79
7,955,240 B2 * 6/2011 Nadim ..... A63B 21/0618 482/146

(Continued)

FOREIGN PATENT DOCUMENTS

JP 11-290406 A 10/1999
KR 10-2012-0072154 A 7/2012

(Continued)

OTHER PUBLICATIONS

International Search Report for PCT/KR2020/017140 dated Mar. 5, 2021.

*Primary Examiner* — Zachary T Moore
(74) *Attorney, Agent, or Firm* — The PL Law Group, PLLC

(57) ABSTRACT

A stand type walking exercise device includes a body structure including a pair of side frames positioned at both the left and right sides of a user, a front frame for connecting the pair of side frames at the front of each of the pair of side frames, and a pair of first fastening frames protruding upward from each of the pair of side frames, a prop structure connected to the upper side of each of the pair of side frames, a safety pad separably bound to the lower side of the prop structure, and a lower structure including support frames which are connected to the lower sides of the pair of side frames and which are in contact with and are supported on the ground, and a pair of rotating parts formed on the support frames.

6 Claims, 8 Drawing Sheets

(58) Field of Classification Search
CPC ..... A63B 22/14; A63B 22/16; A63B 22/18; A63B 23/0405; A63B 23/0417; A63B 23/0464; A63B 23/0476; A63B 21/00058; A63B 21/00061; A63B 21/00065; A63B 21/00178; A63B 21/00181; A63B 21/00185; A63B 21/002; A63B 21/0023; A63B 21/02; A63B 21/04; A63B 21/0407; A63B 21/0414; A63B 21/0421; A63B 21/0428; A63B 21/0435; A63B 21/0442; A63B 21/045; A63B 21/0455; A63B 21/055; A63B 21/0552; A63B 21/0555; A63B 21/0557; A63B 21/15; A63B 21/151; A63B 21/154; A63B 21/22; A63B 21/4027; A63B 21/4033; A63B 21/4034; A63B 21/4035; A63B 21/4039; A63B 21/4045; A63B 21/4047; A63B 21/4049
See application file for complete search history.

(56) References Cited

U.S. PATENT DOCUMENTS

| | | | | |
|---|---|---|---|---|
| 9,393,458 | B1 * | 7/2016 | LaCaze | A63B 22/14 |
| 2022/0152448 | A1 * | 5/2022 | Bosch | A63B 21/0552 |

FOREIGN PATENT DOCUMENTS

| | | | |
|---|---|---|---|
| KR | 10-1174569 | B1 | 8/2012 |
| KR | 10-1825414 | B1 | 2/2018 |
| KR | 10-1966342 | B1 | 4/2019 |
| KR | 10-2113231 | B1 | 5/2020 |

* cited by examiner

STAND TYPE WALKING EXERCISE DEVICE

CROSS REFERENCE TO RELATED APPLICATIONS AND CLAIM OF PRIORITY

This application claims benefit under 35 U.S.C. 119(e), 120, 121, or 365(c), and is a National Stage entry from International Application No. PCT/KR2020/017140, filed Nov. 27, 2020, which claims priority to the benefit of Korean Patent Application No. 10-2019-0155915, filed on Nov. 28, 2019, the entire contents of which are incorporated herein by reference.

BACKGROUND

1. Technical Field

Embodiments of the present invention relate to a stand type walking exercise device.

2. Background Art

A typical walking assist device may support a body when a user performs a walking exercise or moves to another place under a condition in which a lower body muscle and a joint of the user is weaken or damaged or a leg fracture occurs, and be used for a rehabilitation exercise. However, the rehabilitation exercise through the walking assist device has a risk of fall when weak and elderly people who have mobility difficulties use the device.

Thus, although a walking rehabilitation robot has been developed to help rehabilitation of the user, the robot requires expensive costs and is not easily installed. Thus, there is a limitation in supply to general households. Also, since the typical walking assist device is configured to simply assist only one directional walking exercise of the user, lower body muscles and waist muscles of the user may not be entirely and variously used.

SUMMARY

Embodiments of the present invention provides a stand type walking exercise device capable of assisting a walking exercise of a user to help muscle strengthening and dementia prevention.

Embodiments of the present invention also provides a stand type walking exercise device capable of preventing fall of a user during a walking exercise of the user who has mobility difficulties and a risk of injury caused by the fall.

Embodiments of the present invention also provides a stand type walking exercise device capable of increasing ease of installation and carriage convenience of a user due to ease of separation and assembly.

According to an embodiment of the present invention, a stand type walking exercise device includes: a body structure including a pair of side frames respectively disposed at both left and right sides of a user, a front frame configured to connect the pair of side frames in front of each of the pair of side frames, and a pair of first fastening frames respectively protruding upward from the pair of side frames; a prop structure connected to an upper side of each of the pair of side frames through the pair of first fastening frames to support a portion of a body of the user; a safety pad separably bound to a lower side of the prop structure to support a buttocks of the user; and a lower structure including a support frame which are connected to a lower side of each of the pair of side frames and which are in contact with and are supported on the ground and a pair of rotating parts which are formed on the support frame and on which both feet of the user are loaded, and each of the pair of rotating parts independently rotates.

The body structure, the prop structure, the safety pad, and the lower structure may be separated from or assembled with each other.

The prop structure may include an arm support part on which an arm or a shoulder of the user is seated and supported and a pair of height adjustment frames respectively protruding downward from both sides of the arm support part, first support through-holes to which both ends of each of the pair of height adjustment frames are inserted may be defined in ends in both protruding directions of each of the pair of first fastening frames, the pair of height adjustment frames may be assembled with the body structure by a plurality of fastening members while being respectively inserted to the pair of first fastening frames, the plurality of fastening members may pass through and couple each of the pair of height adjustment frames and each of the pair of first fastening frames, and a plurality of height adjustment holes, which are spaced apart from each other at different heights, may be defined in each of the pair of height adjustment frames.

The safety pad may include a pad member configured to surround the buttocks of the user and a plurality of straps each extending from the pad member, each of the plurality of straps may have an adjustable length, and a plurality of ring members to which the plurality of straps are respectively bound may be formed at a lower side surface of the arm support part.

The lower frame may include a bottom frame seated on the ground through a plurality of grounding members each having a predetermined elasticity and a pair of second fastening frames respectively protruding upward from both sides of the bottom frame, a pair of second support through-holes to which both ends of each of the pair of side frames are inserted may be defined in ends in both protruding directions of each of the pair of second fastening frames, the pair of side frames may be assembled with the lower structure by a plurality of coupling members while being respectively inserted to the pair of second fastening frames, and the plurality of coupling members may pass through a side portion of each of the pair of second fastening frames and press and couple each of the pair of side frames.

The front frame may include a connection frame having a predetermined length and a pair of wing frames each extending to one side from both ends in a longitudinal direction of the connection frame, the pair of side frames may be coupled to the wing frames, respectively, in a rotatable manner, an accommodation space may be defined between the connection frame and the pair of wing frames, and the pair of side frames may rotate to be folded in the accommodation space.

According to the embodiments of the present invention, the walking exercise of the user may be assisted to help the muscle strengthening and the dementia prevention.

Also, according to the embodiments of the present invention, the fall of the user who has mobility difficulties during the walking exercise and the risk of injury caused by the fall may be prevented.

Also, according to the embodiments of the present invention, the ease of installation and carriage convenience of the user may increase by the ease of separation and assembly.

DETAILED DESCRIPTION

Hereinafter, preferred embodiments of the present invention will be described with reference to the accompanying drawings. However, this is merely an example, and the embodiments of the present invention are not limited thereto.

Moreover, detailed descriptions related to well-known functions or configurations will be ruled out in order not to unnecessarily obscure subject matters of the present invention. Also, terms used in this specification are terms defined in consideration of functions according to embodiments, and thus the terms may be changed according to the intension or usage of a user or operator. Therefore, the terms should be defined on the basis of the overall contents of this specification.

The description of the present invention is intended to be illustrative, and those with ordinary skill in the technical field of the present invention pertains will be understood that the present invention can be carried out in other specific forms without changing the technical idea or essential features. Hence, the real protective scope of the present invention shall be determined by the technical scope of the accompanying claims.

Figure 1:
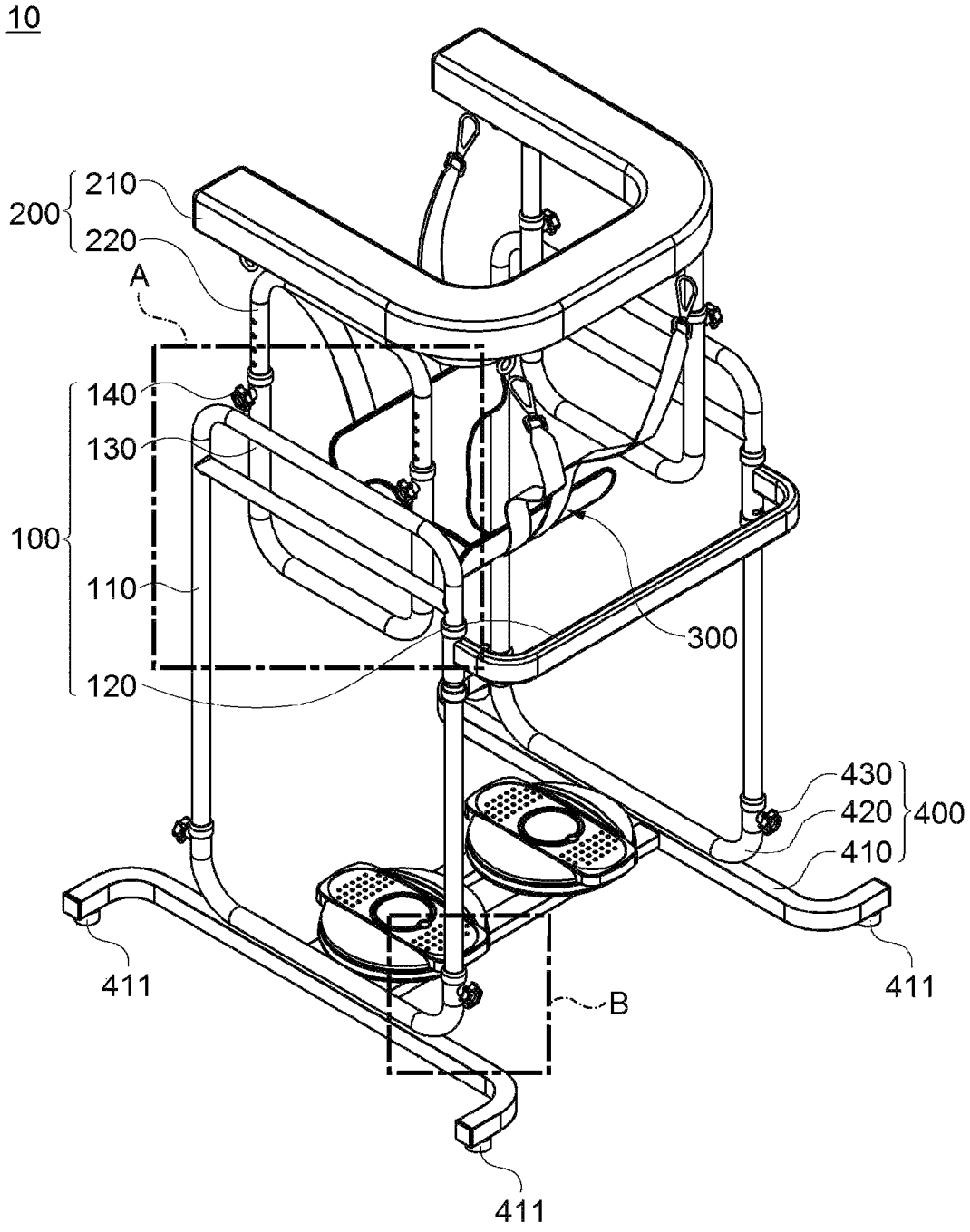
FIG. 1 is a view illustrating a stand type walking exercise device according to an embodiment of the present invention.
Figure 2:
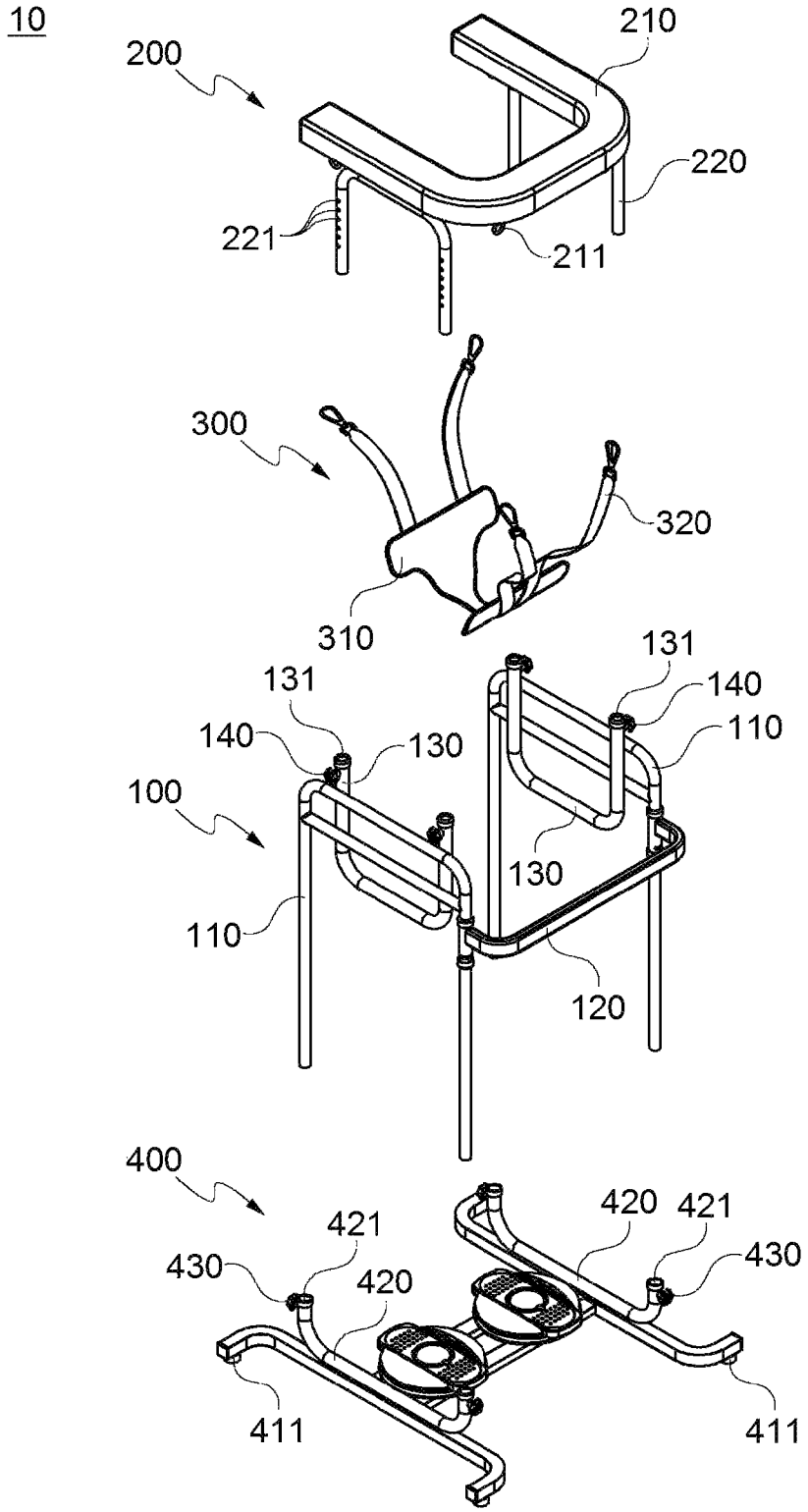
FIG. 2 is a view illustrating the stand type walking exercise device according to an embodiment of the present invention.

FIG. 1 is a view illustrating a stand type walking exercise device 10 according to an embodiment of the present invention, and FIG. 2 is an exploded view illustrating the stand type walking exercise device 10 according to an embodiment of the present invention.

Referring to FIGS. 1 and 2, the stand type walking exercise device 10 according to an embodiment of the present invention may include a body structure 100, a prop structure 200, a safety pad 300, and a lower structure 400. Specifically, the body structure 100 may include a pair of side frames 110 disposed at both left and right sides, respectively, of a user, a front frame 120 connecting the pair of side frames 110 from a front of each of the pair of side frames 110, and a pair of first fastening frames 130 protruding upward from the pair of side frames 110, respectively.

Also, the prop structure 200 may be connected through the pair of first fastening frames 130 disposed at upper portions of the pair of side frames 110, respectively, to support a portion of a body of the user. Also, the safety pad 300 may be separately bound to a lower side of the prop structure 200 and support a buttocks of the user. That is, the safety pad 300 may prevent the user from being fallen and hurt by leg strength loss in a standing state of the user.

Furthermore, the lower structure 400 may include a support frame which is connected to a lower side of each of the pair of side frames 110 and which is in contact with and supported on the ground and a pair of rotating parts which are formed on the support frame and on which both feet are loaded. Here, in case of the stand type walking exercise device 10 according to an embodiment of the present invention, the body structure 100, the prop structure 200, the safety pad 300, and the lower structure 400 may be separated from or assembled with each other. That is, the stand type walking exercise device 10 according to an embodiment of the present invention may be carried or stored in a separated state or easily assembled to be used when necessary.

More specifically, the prop structure 200 may include an arm support part 210 on which an arm or a shoulder of the user is seated and supported and a pair of height adjustment frames 220 protruding downward from both sides of the arm support part 210, respectively. Also, a first support through-hole 131 to which each of the pair of height adjustment frames 220 is inserted may be defined at an end in a protruding direction of each of the pair of first fastening frames 130. That is, each of the pair of first fastening frames 130 may have a hollow shape that is opened in an upward direction.

The lower structure 400 may include a bottom frame 410 seated on the ground through a plurality of grounding members 411 each having a predetermined elasticity and a pair of second fastening frames 420 protruding upward from both sides of the bottom frame 410. Also, a second support through-holes 421 to which each of the pair of side frames 110 is inserted may be defined at an end in a protruding direction of each of the pair of second fastening frames 421. That is, each of the pair of second fastening frames 420 may have a hollow shape that is opened in the upward direction.

Furthermore, the bottom frame 410 may have a predetermined width to face the ground and preferably be in contact with and supported on the ground through four grounding members 411. Here, the four grounding members 411 may be made of a material having a predetermined elasticity such as rubber, and through this, a limitation in which the lower structure is pushed or slipped from the ground during a walking exercise of the user to cause an injury to the user may be prevented.

Each of the pair of rotating parts may include a rotation foot plate having a circular plate shape, in which a ground groove to which a sole of a user's foot is grounded is formed on a top surface thereof and on which an acupressure projection for providing a slippage prevention and acupressure effect is formed and a rotation base coupled with the rotation foot plate through a screw and a washer.

Here, the rotation foot plate may rotate at a predetermined angle around a screw shaft with respect to the rotation base, and a bearing (not shown) may be installed between the rotation base and the rotation foot plate. That is, the rotation base may be fixed to the bottom frame 410 instead of rotating, and the rotation foot plate may independently rotate on the rotation base.

Furthermore, the pair of rotating parts may be independently separated so that both feet of the user are respectively grounded. Through this, exercise may be performed by producing various motions that vary a rotation direction and a rotation angle according to a position at which each foot of the user is loaded, and thus the exercise through the various foot motions allows an upper body of the user as well as muscles of legs and a waist of the user to be free, thereby performing the exercise through whole body like a dance. That is, the stand type walking exercise device 10 according to an embodiment of the present invention may assist a body movement with various motions and types during the waling exercise of the user to help muscle strengthening and dementia prevention.

Figure 3:
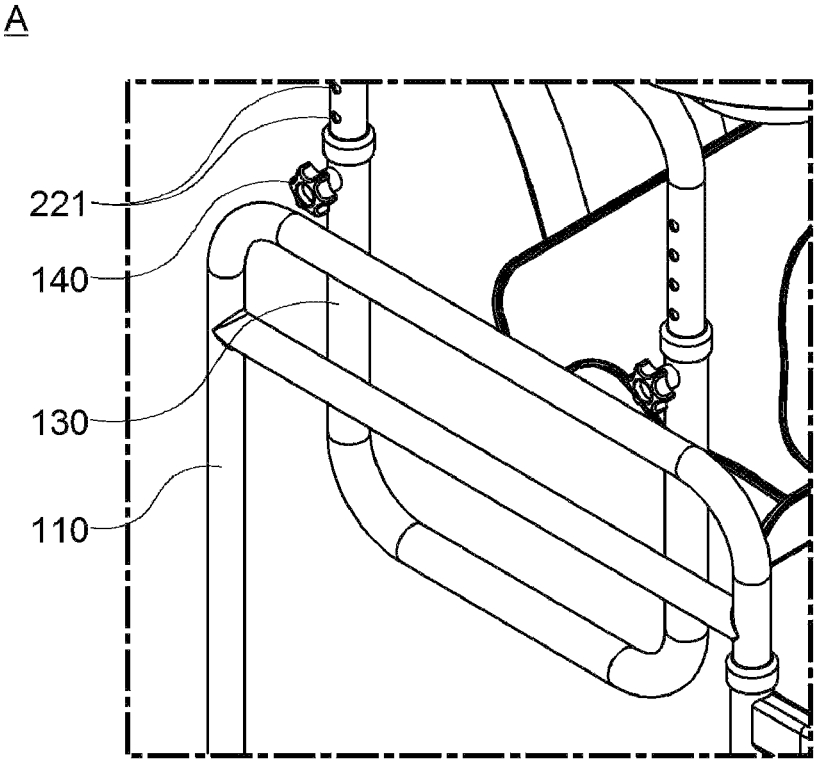
FIG. 3 is an enlarged view illustrating a portion A of FIG. 1.

FIG. 3 is an enlarged view illustrating a portion A of FIG. 1.

Referring to FIG. 3, each of the pair of height adjustment frames 220 may be inserted to the pair of first fastening frames 130, respectively, and assembled with the body structure 100 by a plurality of fastening members 140. Specifically, the plurality of fastening members 140 may penetrate and couple each of the pair of height adjustment frames 220 and each of the pair of first fastening frames 130. Also, a first coupling hole (not shown), which penetrates a side surface in a diameter direction perpendicular to the protruding direction, may be formed in an upper portion of each of the pair of first fastening frames 130, and a plurality of height adjustment holes 221 that are spaced apart from each other at different heights may be formed in each of the pair of height adjustment frames 220.

Here, the first coupling hole may be coaxially aligned to one of the plurality of height adjustment holes 221 according to an arranged height of the prop structure 200. That is, as the fastening member 140 is inserted and coupled in a state in which the first coupling hole and one of the plurality of height adjustment holes 221 are coaxially arranged, the pair of height adjustment frames 220 and the pair of first fastening frames 130 may be assembled and fixed with each other.

Furthermore, a screw line may be formed on an outer surface of each of the plurality of fastening members 140, and through this, the user may operate the fastening member 140 to rotate, thereby coupling the body structure 100 and the prop structure 200 to each other. Furthermore, as the fastening member 140 is coupled with one of the plurality of height adjustment holes 221, a coupling height of the prop structure 200 with respect to the body structure may be differently formed. That is, the height of the prop structure 200 may be easily adjusted according to a height of the user, etc.

Also, as the prop structure 200 is assembled with the body structure 100, an arranged state of the pair of side frames 110 may be fixed, and the pair of side frames 110 may be installed while maintaining an unfolded state with respect to the front frame 120.

Figure 4:
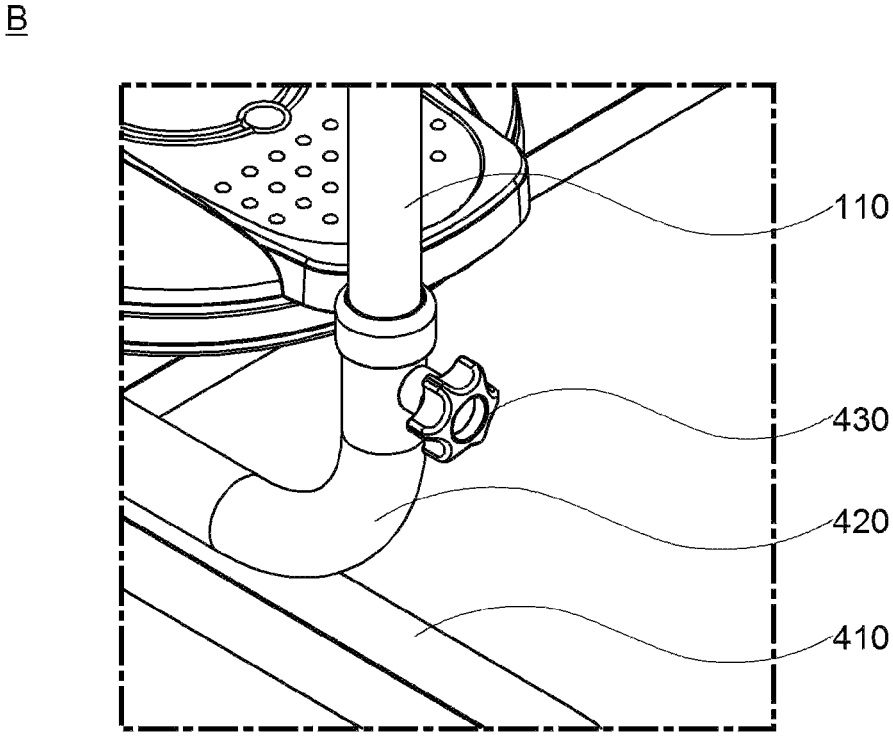
FIG. 4 is an enlarged view illustrating a portion B of FIG. 1.

FIG. 4 is an enlarged view illustrating a portion B of FIG. 1.

Referring to FIG. 4, each of the pair of side frames 110 may be inserted to the pair of second fastening frames 420, respectively, and assembled with the lower structure 400 by a plurality of coupling members 430. Specifically, a second fastening hole (not shown), which penetrates a side surface in a diameter direction perpendicular to the protruding direction, may be formed in an upper portion of each of the pair of second fastening frames 420. Here, the coupling members 430 may be inserted to the second fastening holes, respectively, and the plurality of coupling members 430 may respectively pass through the pair of second fastening frames 420 through the second fastening holes and respectively press and be couple the pair of side frames 110.

More specifically, when the pair of side frames 110 are inserted to the second support through-holes 421 of the second fastening frame 420, each of the pair of side frames 110 is inserted to a lower end sealing surface of the second support through-hole 421 and inscribed in each of the second fastening frames 420. Here, a screw line may be formed in an outer surface of each of the plurality of coupling members 430, and the user may operate each of the plurality of coupling members 430 respectively inserted to the second fastening holes to rotate, thereby pressing an outer surface of each of the pair of side frames 110 inscribed in the second fastening frames 420.

That is, the user may assemble the lower structure 400 and the body structure 100 with each other by simply inserting lower portions of the pair of side frames 110 to the pair of second fastening frames 420 and operating the plurality of coupling members 430 to rotate. Through this, the user may easily assemble the lower structure 400 and the body structure 100 by oneself without help of an assistant. In case of disassembling, the coupling member 430 may be separated, and the body structure 100 may be separated from the lower structure 400 in a reverse order.

Also, as the lower structure 400 is assembled with the body structure 100, an arranged state of the pair of side frames 110 may be fixed, and the pair of side frames 110 may be coupled and fixed to the lower structure 400 while maintaining an unfolded state. That is, structural safety may be maintained during the walking exercise of the user.

Figure 5:
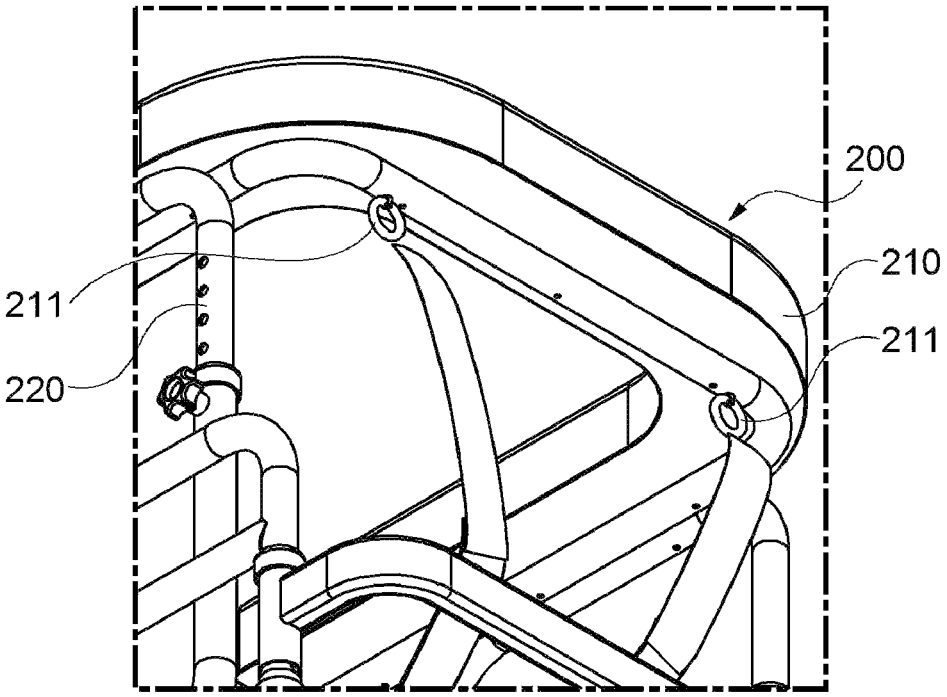
FIG. 5 is a view illustrating a lower side surface of a prop structure of the stand type walking exercise device according to an embodiment of the present invention.
Figure 6:
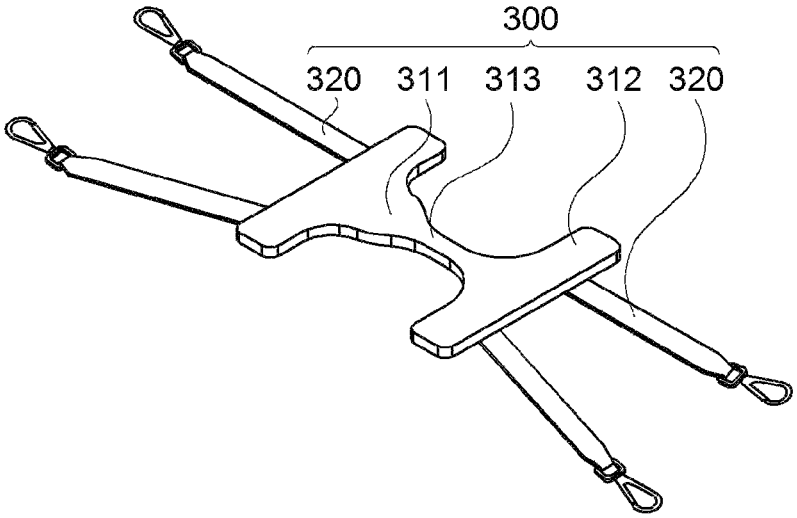
FIG. 6 is a view illustrating a safety pad of the stand type walking exercise device according to an embodiment of the present invention.

FIG. 5 is a view illustrating a lower side surface of the prop structure 200 of the stand type walking exercise device 10 according to an embodiment of the present invention, and FIG. 6 is a view illustrating the safety pad 300 of the stand type walking exercise device 10 according to an embodiment of the present invention.

Referring to FIGS. 5 and 6, the safety pad 300 may include a pad member 310 surrounding the buttocks of the user and a plurality of straps 320 each extending from the pad member 310. Also, each of the plurality of straps 320 may has an adjustable length, and the pad member 310 may be connected to a lower side surface of the arm support part 210 through the plurality of straps 320. That is, the safety pad 300 may be connected to the arm support part 210 and spaced apart from a lower side of the arm support part 210.

Also, the safety pad 300 may be spaced downward by a predetermined distance not to directly contact the buttocks when the user stands on the pair of rotating parts. Through this, the user may support the body by using only leg muscles of the user in a state in which a weight of the user is not distributed, and an efficiency of strengthening leg muscles and waist muscles during the walking exercise of the user may remarkably increase. Also, even when the user falls down due to leg strength loss during the walking exercise, a fall risk may be prevented by supporting the body of the user by the safety pad 300.

Furthermore, the safety pad 300 may be positioned to support the body weight of the user by contact-supporting the buttocks of the user when the user stands on the pair of rotating parts. Through this, even when the user hardly stands while supporting the weight of the user due to degradation of a leg muscle function, the walking exercise may be performed in a state in which the body is supported by the safety pad 300, and a rehabilitation exercise may be performed.

Also, a plurality of ring members 211 to which the plurality of straps 320 are respectively coupled may be formed on the lower side surface of the arm support part 210. That is, the safety pad 300 may be coupled such that the plurality of straps 320 is hook-coupled with a ring structure to the plurality of ring members 211, respectively. Through this, the user may connect or separate the safety pad 300 to or from the prop structure 200 without help of the assistant, and ease of assembly and disassembly of the user may increase.

Furthermore, the pad member 310 may include a first pad 311 surrounding the buttocks of the user, a second pad 312 surrounding a front of the waist of the user, and a connection part 313 connecting the first pad 311 and the second pad 312 and disposed between both legs of the user. That is, the safety pad 300 may support the body of the user regardless of a direction in which the user falls down and have a shape that does not invade a scope of movement of the legs during the walking exercise of the user.

Figure 7:
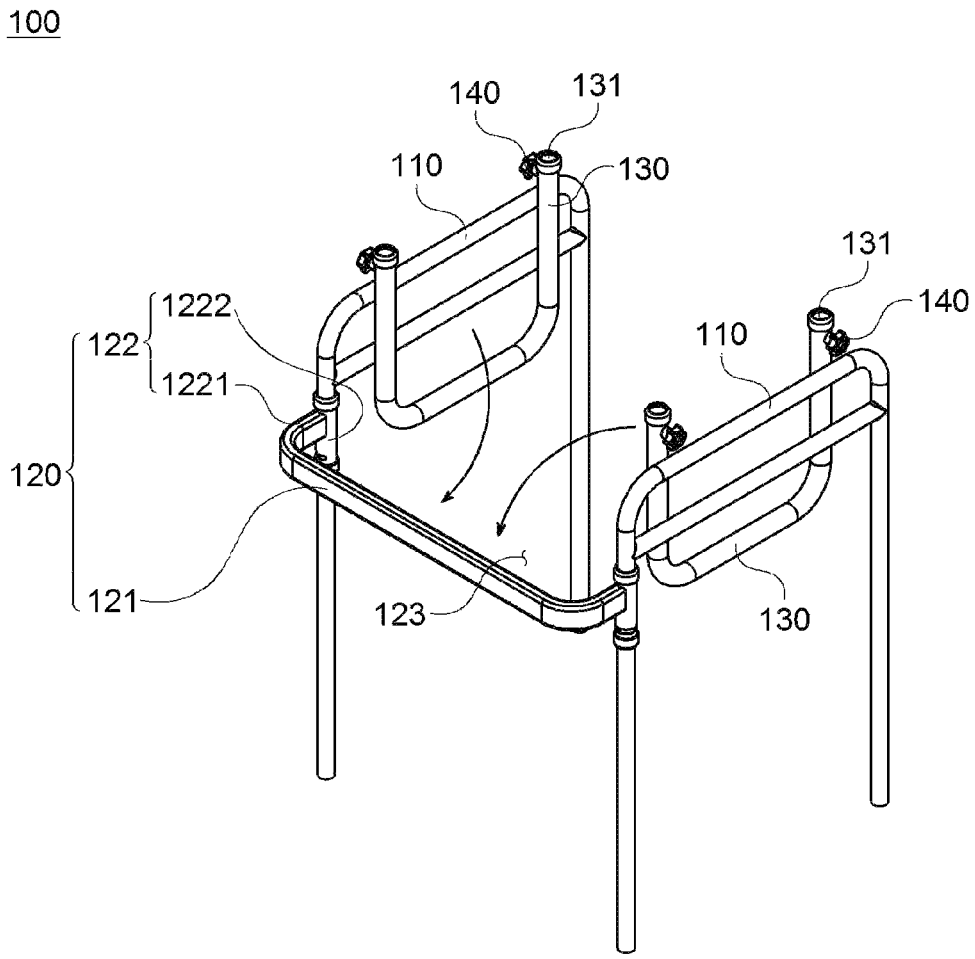
FIG. 7 is a view illustrating an unfolded state of a body structure of the stand type walking exercise device according to an embodiment of the present invention.
Figure 8:
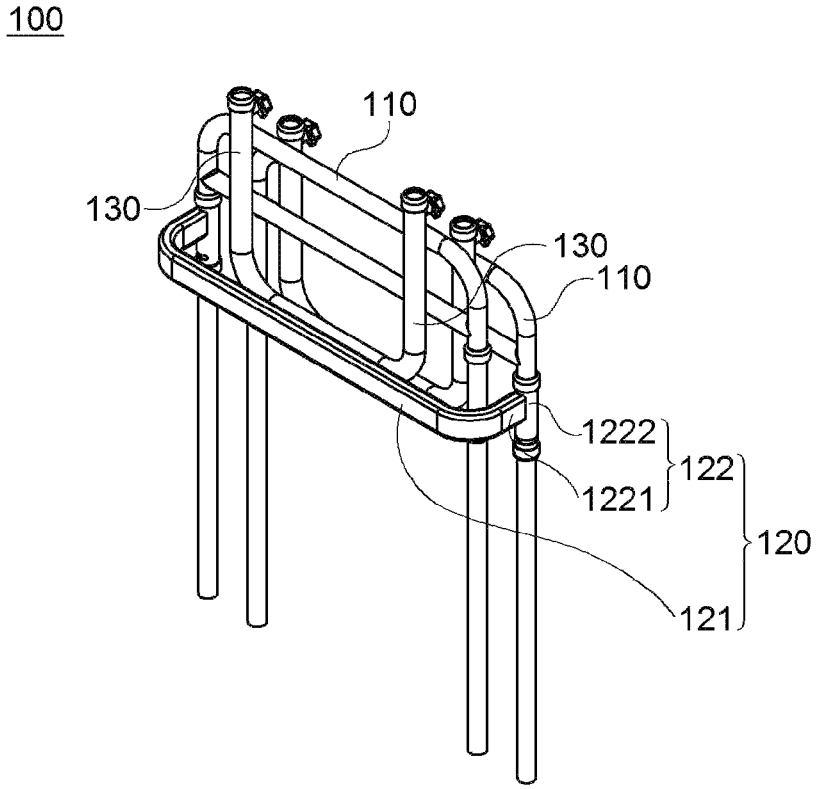
FIG. 8 is a view illustrating a folded state of the body structure of the stand type walking exercise device according to an embodiment of the present invention.

FIG. 7 is a view illustrating an unfolded state of the body structure 100 of the stand type walking exercise device 10 according to an embodiment of the present invention, and FIG. 8 is a view illustrating a folded state of the body structure 100 of the stand type walking exercise device 10 according to an embodiment of the present invention.

Referring to FIGS. 7 and 8, the front frame 120 may include a connection frame 121 having a predetermined length and a pair of wing frames 122 respectively extending from both ends in a longitudinal direction of the connection frame 121 in one direction, and the pair of side frames 110 may be respectively coupled to the wing frames 122 in a rotational manner. Also, an accommodation space 123 may be defined between the connection frame 121 and the pair of wing frames 122, and the pair of side frames 110 may rotate to be folded and be positioned in the accommodation space 123.

Specifically, each of the wing frames 122 may include a first extension part 1221 extending by a predetermined length from one of the both ends of the connection frame 121 and a second extension part 1222 extending by a predetermined length in a direction perpendicular to a longitudinal direction of the first extension part 1221. Here, the pair of side frames 110 may be respectively coupled to the second extension parts 1222 disposed at the both sides of the connection frame 121 in a rotational manner.

More preferably, each of the second extension parts 1222 may have a hollow cylinder shape having opened both ends, and a portion of each of the pair of side frames 110 may be inscribed in and pass through each of the extension parts 1222 to mutually rotate.

Furthermore, the pair of side frames 110 may rotate to be folded. Preferably, each of the pair of side frames 110 may rotate with respect to a shaft in a longitudinal direction of the second extension part 1222 and be folded together with the connection frame 121, and the pair of side frames 110 may be positioned in the accommodation space 123 in a mutually folded state. That is, the side frames 110 in the folded state may not protrude to the outside of the front frame 120, and thus a volume of a shape of the body structure 100 may be reduced.

Through this, the user may fold and arrange the pair of side frames 110 when carry or store the stand type walking exercise device 10 according to an embodiment of the present invention and carry or store body structure 100 by minimizing the volume thereof.

Although the embodiments of the present invention have been described, it is understood that the present invention should not be limited to these embodiments but various changes and modifications can be made by one ordinary skilled in the art within the spirit and scope of the present invention as hereinafter claimed. Therefore, the scope of this disclosure is defined not by the detailed description of the invention but by the appended claims, and all differences within the scope will be construed as being included in the present disclosure.

What is claimed is:

1. A stand type walking exercise device comprising:

a body structure comprising a pair of side frames configured to be respectively disposed at both left and right sides of a user, a front frame configured to connect the pair of side frames in front of each of the pair of side frames, and a pair of first fastening frames configured to be respectively protruding upward from the pair of side frames;

a prop structure connected to an upper side of each of the pair of side frames through the pair of first fastening frames configured to support a portion of a body of the user;

a safety pad separably bound to a lower side of the prop structure configured to support a buttock of the user; and a lower structure comprising a support frame connected to a lower side of each of the pair of side frames and in contact with and supported on the ground and a pair of rotating parts formed on the support frame configured to load both feet of the user thereon, wherein each of the pair of rotating parts independently rotates;

the prop structure further comprises an arm support part on which an arm or a shoulder of the user is seated and supported and a pair of height adjustment frames respectively protruding downward from both sides of the arm support part;

a pair of first support through-holes, wherein both ends of each of the pair of height adjustment frames are inserted into the pair of first support through holes, and wherein the pair of first support through holes are defined in ends of each of the pair of the first fastening frames in both an upwards and a downwards protruding direction of each of the pair of first fastening frames;

the support frame further comprises a bottom frame seated on the ground through a plurality of grounding members each having a predetermined elasticity and a pair of second fastening frames respectively protruding upward from both sides of the bottom frame; and a pair of second support through-holes, wherein both ends of each of the pair of side frames are inserted into the pair of second support through holes and wherein the pair of second support through holes are defined in ends of each of the pair of the second fastening frames in both an upwards and a downwards protruding direction of each of the pair of second fastening frames.

2. The stand type walking exercise device of claim 1, wherein the body structure, the prop structure, the safety pad, and the lower structure are configured to be separated from or assembled with each other.

3. The stand type walking exercise device of claim 2, wherein the pair of height adjustment frames are assembled with the body structure by a plurality of fastening members while being respectively inserted into the pair of first fastening frames;

the plurality of fastening members pass through and couple each of the pair of height adjustment frames and each of the pair of first fastening frames; and a plurality of height adjustment holes spaced apart from each other at different heights, the plurality of height adjustment holes defined in each of the pair of height adjustment frames.

4. The stand type walking exercise device of claim 3, wherein the safety pad comprises a pad member configured to surround the buttocks of the user and a plurality of straps each extending from the pad member;

each of the plurality of straps has an adjustable length; and a plurality of ring members to which the plurality of straps are respectively coupled are formed at a lower side surface of the arm support part.

5. The stand type walking exercise device of claim 2, wherein the pair of side frames are assembled with the lower structure by a plurality of coupling members while being respectively inserted into the pair of second fastening frames; and the plurality of coupling members pass through a side portion of each of the pair of second fastening frames and press and couple each of the pair of side frames.

6. The stand type walking exercise device of claim 1, wherein the front frame comprises a connection frame having a predetermined length and a pair of wing frames each extending to a respective side of the connection frame and from both ends of the connection frame in a longitudinal direction;

the pair of side frames are coupled to the wing frames, respectively, in a rotatable manner;

an accommodation space is defined between the connection frame and the pair of wing frames; and the pair of side frames rotatable to be folded into the accommodation space.

* * * * *